US010272978B2

(12) United States Patent
Belchamber

(10) Patent No.: US 10,272,978 B2
(45) Date of Patent: Apr. 30, 2019

(54) SCUBA CYLINDER LOWER SIDE MOUNTING SYSTEM

(71) Applicant: David James Belchamber, Ottawa (CA)

(72) Inventor: David James Belchamber, Ottawa (CA)

( * ) Notice: Subject to any disclaimer, the term of this patent is extended or adjusted under 35 U.S.C. 154(b) by 0 days.

(21) Appl. No.: 15/685,124

(22) Filed: Aug. 24, 2017

(65) Prior Publication Data

US 2018/0162500 A1 Jun. 14, 2018

Related U.S. Application Data

(60) Provisional application No. 62/433,446, filed on Dec. 13, 2016.

(51) Int. Cl.

| | |
|---|---|
| ***B63C 11/22*** | (2006.01) |
| ***B63C 11/30*** | (2006.01) |
| ***A63B 35/12*** | (2006.01) |
| *A45F 3/14* | (2006.01) |

(52) U.S. Cl.

CPC ..... *B63C 11/2245* (2013.01); *A63B 35/12* (2013.01); *B63C 11/22* (2013.01); *B63C 11/30* (2013.01); *A45F 3/14* (2013.01); *B63C 2011/2281* (2013.01)

(58) Field of Classification Search

CPC ..... B63C 11/2245; B63C 11/22; B63C 11/02; B63C 2011/2281; B63C 2011/026; B63C 11/30; Y10T 24/4002; Y10T 24/4023; Y10T 24/4086; B63B 35/12; A45F 3/14

USPC ..... 224/934; 405/185–186

See application file for complete search history.

(56) References Cited

U.S. PATENT DOCUMENTS

| | | | |
|---|---|---|---|
| 5,522,679 | A | 6/1996 | Eungard |
| 2007/0000963 | A1 | 1/2007 | Ammerman |

FOREIGN PATENT DOCUMENTS

| | | |
|---|---|---|
| DE | 202009000781 | 3/2009 |
| GB | 2527327 | 12/2015 |

OTHER PUBLICATIONS

Advanceddivermagazine.com/armadillo.html (copyright 2009), last visited Sep. 12, 2018.*

(Continued)

*Primary Examiner* — Scott T McNurlen

(74) *Attorney, Agent, or Firm* — Gardner, Linn, Burkhart & Ondersma LLP

(57) ABSTRACT

A scuba cylinder lower side mounting system employs two mating parts to secure the lower portion of a scuba cylinder to a diver's torso, the first affixed to either side of any side-mount or back mount Buoyancy Control Device utilizing a web waistband. A web cylinder band or stainless steel hose-clamp secures the second part to any scuba cylinder. The two parts are engaged whether in or out of the water by inserting the second part into the first and pivoting the cylinder at the point of attachment. Existing arrangements to position the cylinder valve near the diver's armpit will keep the system locked in place. It may be disengaged before entering or engaged after exiting confined underwater spaces without reaching between the cylinder and diver's torso. The system keeps the cylinder close to and aligned with the diver's torso regardless of the cylinder's change in buoyancy or diver orientation.

14 Claims, 8 Drawing Sheets

(56) References Cited

OTHER PUBLICATIONS

Utdscubadiving.com/en/products/category/z-sidemount-systems, last visited Feb. 3, 2016 (via Wayback Machine).*
Scubatechphillipines.com/scuba_blog/sidemount-harness/, last visited Jul. 27, 2016 (via Wayback Machine).*
PCT Search Report and Written Opinion for International PCT Application No. PCT/CA2017/051475, dated Mar. 5, 2018.

* cited by examiner

Fig. 26
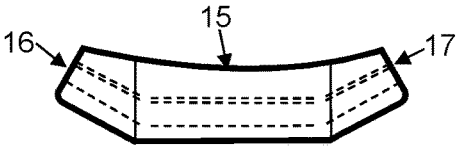
Fig. 27
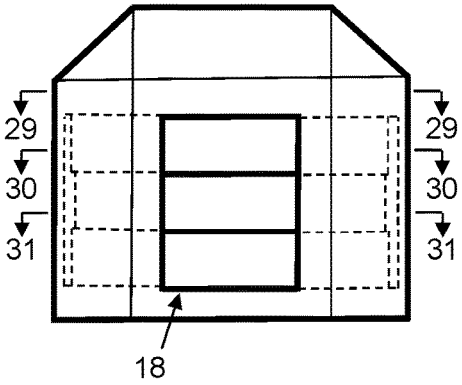
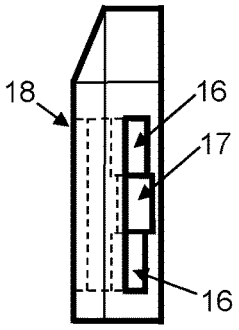
Fig. 28
Fig. 29
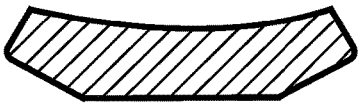
Fig. 30
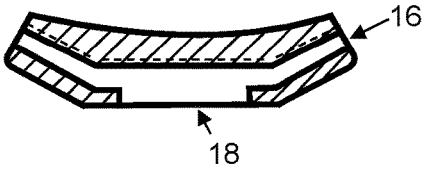
Fig. 31
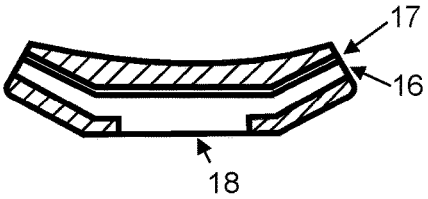

Fig. 32
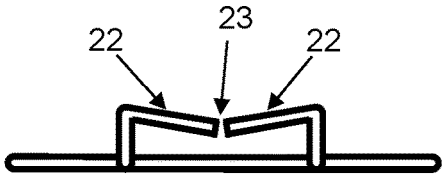
Fig. 33
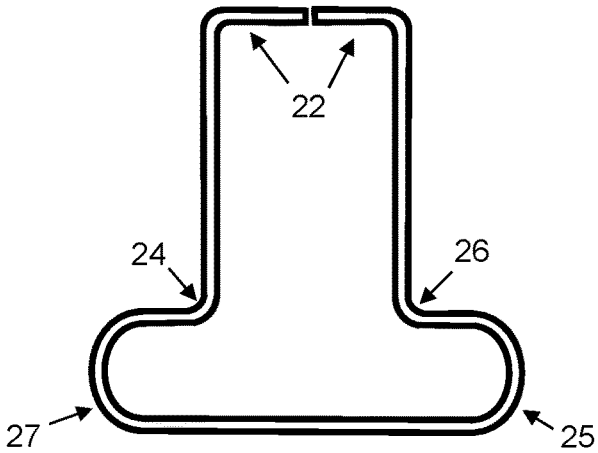
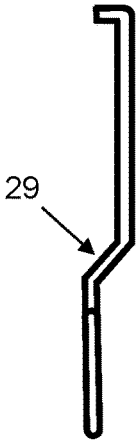
Fig. 34
Fig. 35
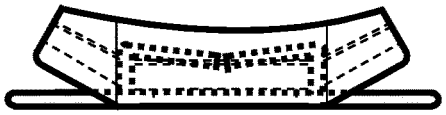
Fig. 37
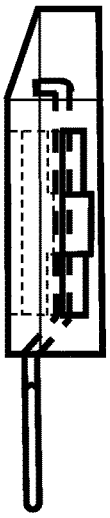
Fig. 36
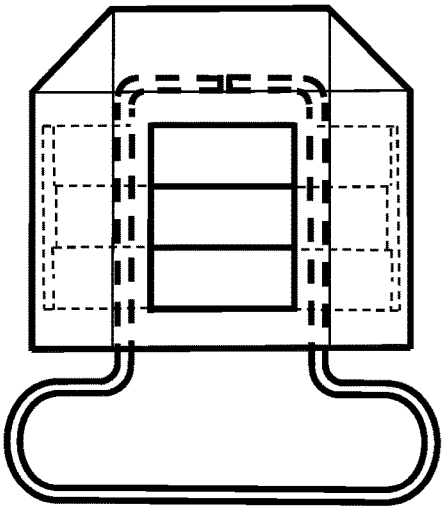

SCUBA CYLINDER LOWER SIDE MOUNTING SYSTEM

CROSS REFERENCE TO RELATED APPLICATION

The present application claims the filing benefits of U.S. provisional application Ser. No. 62/433,446, filed Dec. 13, 2016, which is hereby incorporated herein by reference in its entirety.

TECHNICAL FIELD

The invention relates generally to self contained underwater breathing apparatus (scuba) equipment and more particularly to a mounting system for scuba cylinders.

BACKGROUND

In contrast to back-mounted systems in which one or two dive cylinders are affixed to a diver's Buoyancy Control Device (BCD) in such manner that the cylinder(s) are located on the diver's back, side-mount configurations position a cylinder along each side of a diver's torso, with the cylinder valves located comfortably near the diver's armpits. The side-mount arrangement was first developed in the 1960s by British cave explorers, looking for a method to more effectively carry dive cylinders alongside the outer thigh. This allowed them to crawl, or wiggle, through dry cave sections, whilst presenting a secure method of attachment for passing through submerged areas. American cave divers incorporated the 'English system' in the 1970s to facilitate exploration of Florida's vast network of submerged caves. However, the ensuing long swims placed greater emphasis on buoyancy and trim and the need to reposition the cylinder from low against the thigh, up to the armpit and against the torso. The rigs used by these underwater cave explorers were either built 'from scratch' or incorporated harness and bladder adaptations from 'off-the-shelf' scuba equipment. The first commercial side-mount diving system was designed by Lamar Hires in the mid 1990s and manufactured by Dive Rite. In 2001 Brett Hemphill designed the Armadillo Side-Mount Harness that incorporated a number of innovative features. Widespread popularity of side-mount systems did not truly emerge until the mid 2010s with growing interest in technical and cave diving. Commercial production of various side-mount designs by the likes of DiveRite, Halcyon, Hollis, OMD, SCUBAPRO, UTD and others have given rise to BCDs such as the Razor 2.0, Deep Stealth, UTD-Z Trim, Aquamundo, Diamond, Armadillo, Nomad, Contour, SMS75, SMS100 and Katana. (Reference Source: Wikipedia—Sidemount Diving)

Recreational side-mount BCDs, i.e., BCDs designed for divers that perform neither decompression dives nor cave dives were also popularized in the mid 2010s by firms such as Hollis.

Prior art to affix a scuba cylinder's lower point of attachment to a side-mount BCD universally includes three parts: 1) a bolt snap, 2) a piece of stout braided cord strong enough to support the weight of a dive cylinder, made into a loop by tying the two ends with an overhand knot (or a piece of shock cord similarly configured—provided the upper point of attachment is capable of supporting the cylinder's weight), and 3) either a web cylinder band having an appropriate clamping device or a hose-clamp that encircles a dive cylinder and is tightened thereto. The three are attached to each other by first passing the loop through the bolt snap's ring and then around the entire bolt snap, or by passing the cord through the bolt snap's ring before tying the ends. With a tri-glide loosely in place on a web cylinder band, the knot forming the loop of cord is passed through the loop of web formed at the tri-glide and held fast by tightening the loop of web, thereby trapping the knot so that the cord cannot pull free of the tri-glide. The web cylinder band is then suitably positioned on the dive cylinder and tightened thereto. Alternatively, the knot forming the loop of cord is tucked under a hose clamp immediately prior to tightening the hose-clamp around a dive cylinder.

With the bolt snap thus secured to the side of a dive cylinder at an appropriate location, the lower portion of the cylinder may now be attached to the metal rail affixed to either side of the lower rear portion of BCD backplates designed for side-mount configurations, or to a D ring located low on the BCD, for instance on the web waistband of BCDs so equipped. Prior to entering the water, this arrangement must support the weight of a dive cylinder.

A number of arrangements have been developed over the years to position the upper portion of a dive cylinder so that the cylinder valve comfortably sits near the diver's armpit. One such arrangement includes a shock cord formed into a loop, both ends of which are attached to the upper back portion of BCDs designed for side-mount. The shock cord may also pass through a loop secured to the shoulder harness in order to position the shock cord for ready access by the diver. When stretched, the loop of shock cord is then passed around the cylinder valve and hooked around either the valve handle or the post opposite. Another arrangement has one end of a length of shock cord tied or clipped by means of a bolt snap to the upper back portion of BCDs designed for side-mount. A bolt snap is affixed to the free end which, when stretched, is made to pass around the cylinder valve before being clipped onto a D ring affixed to the BCD shoulder harness. A variation of this includes a metal ring affixed to the free end followed by a chain link and bolt snap. The bolt snap is then clipped to a D ring on the BCD shoulder harness. A bolt snap with the snap portion tightly secured to the neck of a dive cylinder is then clipped to the metal ring. This arrangement provides support to the cylinder whether or not the lower point of attachment is secured. In the case of cylinders used to augment BCDs having back mounted cylinders, a short length of cord is passed through the ring of a bolt snap and tied so as to form a loop just large enough to pass over the cylinder valve prior to mounting a regulator on the valve. The bolt snap is then clipped to a D ring mounted on the shoulder harness. This latter arrangement often uses shock cord for the lower point of attachment and relies on the upper bolt snap/cord to support the cylinder's weight.

The manner in which a dive cylinder is thus affixed to a BCD in a position to one side or the other of a diver's torso may be accomplished before or after entering the water. When in the water, unclipping the lower portion of the dive cylinder allows it to be maneuvered in an arc so as to position the cylinder above the diver's head, in line with the diver's body by leaving the upper attachment in place. Once accomplished with one or both side mounted cylinders, the diver is thus able to swim through confined areas such as those encountered in caves or wrecks. Having exited such confined spaces, the diver then repositions the cylinder(s) back along the torso and re-clips the bolt snap to the lower point of attachment.

The length of cord between the bolt snap and dive cylinder at the lower point of attachment is determined to some extent by the need to reach between the diver's torso and the cylinder in order to clip the bolt snap onto or unclip the bolt snap from the BCD. This is exacerbated when, in the case of cold water, the diver must wear gloves for thermal protection. In such cases, bolt snaps are usually larger to facilitate easier manipulation. Bulky gloves necessitate establishing a greater distance between the dive cylinder and BCD in order to facilitate reaching between the two during clipping and unclipping activities. In any event, the distance established by the combination of bolt snap and cord creates the opportunity for the dive cylinder to move freely within an arc, more so for cold water divers.

This arc of movement becomes critical whenever utilizing aluminum dive cylinders which change from negative buoyancy when full to positive buoyancy over the course of a dive as the breathing gas is consumed. Unfortunately, aluminum cylinders are almost exclusively utilized by cave divers and rental facilities at dive destinations. When utilizing such cylinders, the cylinder begins by being appropriately positioned along the diver's torso when swimming in a normal, belly down orientation, but then rides with the lower portion of the cylinder floating ever higher and away from the torso over the course of a dive. The angle thus formed by the cylinder and diver's torso can easily exceed 45 degrees. This then diminishes the streamlined benefit of having cylinders tucked along the diver's torso in order to minimize breathing effort and gas consumption. The added cross-sectional dimension of diver/cylinder combination arising from poorly positioned cylinders also increases the need to re-configure cylinders for confined water operation when passing through reasonably open swim-throughs or doorways in wrecks even though properly positioned cylinders would obviate the need to re-configure.

To overcome the previously identified weakness, divers utilizing aluminum cylinders typically add one or two pair of D rings to their BCD waistband to enable repositioning the lower point of attachment closer to the belt buckle, that is, closer to the midline, so as to reduce the degree to which the lower portion of the cylinder rides upwards. Alternatively, some diver's utilize sliding D rings that can be repositioned during the dive to create the same effect. However, these arrangements exacerbate the availability of valuable real estate along the waistband's length otherwise needed for weight systems and accessories such as dive knives and cutting tools. Furthermore, the cylinders still float away from the diver's torso when swimming in anything other than a belly down orientation.

This situation is minimized when utilizing steel cylinders which remain negatively buoyant regardless of their state of fill. Even so, gravity creates the same effect of poorly positioned cylinders when swimming in anything other than a belly-down orientation, regardless of the BCD point of attachment. Moreover, the change in centre of gravity occurring when heavy steel cylinders are positioned for swim-throughs makes aluminum cylinders the preferred choice for cave divers.

Finally, the issue of movement of a dive cylinder, even to a small degree creates issues when walking on a moving vessel or negotiating a rocky shoreline. Loss of balance becomes dangerous when two cylinders, especially heavier steel cylinders, are attached to the BCD prior to entering the water.

It is apparent from the foregoing that the prior art fails to hold the lower portion of a dive cylinder in its desired position, that is, close to the diver's torso, regardless of the cylinder's state of fill and regardless of the diver's orientation within the water, while aboard dive vessels, or while walking on rocky shorelines. Moreover, the need to reach between the diver's torso and a dive cylinder in order to manipulate a bolt snap when clipping to or unclipping from a BCD, especially whilst wearing thick neoprene gloves, is problematic.

SUMMARY

The invention overcomes the deficiencies associated with use of a bolt snap/cord combination for mounting and dismounting scuba cylinders at the lower point of attachment by establishing a two-part system that locks together when oriented appropriately.

The first part (hereinafter referred to as a BCD Bracket) is affixed to a diver's BCD web waistband utilizing standard off-the-shelf tri-glides. An alternate arrangement includes tri-glides welded to the back of the bracket to better distribute a cylinder's weight on the BCD web waistband. An extended arrangement (hereinafter referred to as the Extended BCD Bracket) is designed to share the same portion of BCD web waistband as a removable weight system. To do so, the Extended BCD Bracket is mounted on the waistband behind the weight system utilizing custom tri-glides welded to the back of the bracket. The bracket portion of the Extended BCD Bracket is taller so as to position the shelf below the weight system. The shelf is also extended to overcome the thickness of the weight system, even when that system is fully loaded with weights. By extending the shelf, there is a greater bending force applied to the shelf when a cylinder is in position. The custom tri-glides extend around the bottom bends and are welded to the bracket to both distribute the cylinder's weight on the waistband and to strengthen the shelf. A secondary benefit of the lengthened custom tri-glides is that they increase the surface area of the bracket against the diver's thigh, thereby reducing the impact of the bracket digging into the diver's thigh when subjected to the weight of a cylinder prior to entering the water. The BCD Bracket, BCD Bracket with integral tri-glides and Extended BCD Bracket are composed of stainless steel rod and, in the latter two cases stainless steel tri-glides, so as to avoid oxidation in salt water, bent into the shapes identified in the attached diagrams. The rod is of sufficient strength to overcome loads imposed by the weight of a dive cylinder and potential mishaps.

The second part (hereinafter referred to as the Cylinder Bracket) is affixed to the dive cylinder at a location that causes the cylinder valve to be positioned comfortably near the diver's armpit, i.e., in a streamlined position. The Cylinder Bracket is composed of stainless steel rod, so as to avoid oxidation in salt water, bent into the shapes identified in the attached diagrams and embedded in a rubber pad. The rod is of sufficient strength to overcome loads imposed by the weight of a dive cylinder and potential mishaps. The rubber pad has a horizontal slot from one side to the other and wide enough to accommodate a standard 2" web cylinder band, plus an indentation within that slot to correctly position a stainless steel hose clamp, either of which may be utilized to secure the Cylinder Bracket to the side of a cylinder. Alternate rubber pads may include either a slot for a 2" web cylinder band or a smaller slot for a stainless steel hose-clamp rather than providing for both arrangements in a single design. The concave back surface of the rubber pad matches that of a standard 7.25" diameter scuba cylinder and is ridged to create a non skid surface to facilitate securely clamping the Cylinder Bracket to a cylinder. The rubber must be UV resistant and hard enough to withstand compressive loads while maintaining shape, but flexible enough to facilitate bending to conform to varying dive cylinder diameters. A Shore Hardness of approximately 85 is appropriate. By "approximately", it is understood that a variance of +/−10% would be suitable.

When connected, the two parts restrict cylinder movement regardless of the diver's swimming orientation or the cylinder's state of buoyancy. Furthermore, once the cylinder valve is securely in position, the cylinder will remain in its locked position until the diver orients the cylinder into its unlock position, which may be accomplished whenever required in or out of the water. The invention establishes minimal space between the diver's torso and the cylinder thereby increasing the effect of streamlining and obviates the need for the diver to position their hand between the torso and cylinder, nor in a shoulder twisting movement to clip or unclip a primary cylinder to a rail on the lower back portion of a side-mount BCD backplate.

Finally, the device does not preclude attachment of additional cylinders, utilizing traditional bolt snap/shock cord arrangements, required by technical divers having need of additional decompression gases and/or additional volume of standard breathing gases. Such cylinders may still be secured to the BCD either behind or in front of the primary side mounted cylinders. Furthermore, the device may be used in conjunction with any BCD having a web waistband. This enables divers with back mounted cylinders to augment their volume of breathing gases by adding side mounted cylinders that remain comfortably positioned along the diver's torso, regardless of their state of fill or diver orientation in the water column.

BRIEF DESCRIPTION OF THE DRAWINGS

FIG. 26 is a top plan view of the rubber portion of the improved Cylinder Bracket;

FIG. 27 is a front plan view of the rubber portion of the improved Cylinder Bracket;

FIG. 28 is a side plan view of the rubber portion of the improved Cylinder Bracket;

FIG. 29 is a sectional view taken generally on line 29-29 of FIG. 27;

FIG. 30 is a sectional view taken generally on line 30-30 of FIG. 27;

FIG. 31 is a sectional view taken generally on line 31-31 of FIG. 27;

FIG. 32 is a top plan view of the stainless steel portion of the improved Cylinder Bracket;

FIG. 33 is a front plan view of the stainless steel portion of the improved Cylinder Bracket;

FIG. 34 is a side plan view of the stainless steel portion of the improved Cylinder Bracket;

FIG. 35 is a top plan view of the improved Cylinder Bracket having the stainless steel portion embedded in the rubber portion;

FIG. 36 is a front plan view of the improved Cylinder Bracket having the stainless steel portion embedded in the rubber portion;

FIG. 37 is a side plan view of the improved Cylinder Bracket;

DETAILED DESCRIPTION OF EMBODIMENTS

Figure 1:
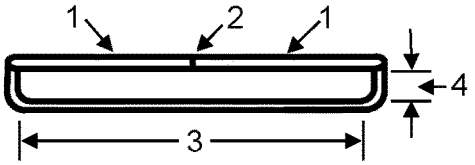
FIG. 1 is a top plan view of a BCD Bracket.

Disclosed herein is an improvement for securing the lower portion of self contained underwater breathing apparatus (scuba) cylinders along either side of a diver's torso when the diver is equipped with any Buoyancy Control Device (BCD) having a web waistband whether or not the BCD is designed for side-mount or back mounted configurations, the latter having side mounted cylinders to augment back mounted cylinders. The invention facilitates easily mounting and dismounting a cylinder whether in or out of the water or before entering and after exiting confined underwater spaces such as those encountered in caves and wrecks. It keeps the cylinder aligned with the diver's torso regardless of the cylinder's change in buoyancy as breathing gases are consumed and eliminates any need to reach between the cylinder and diver's torso during mounting or dismounting operations, thereby enabling the cylinder to be positioned close to the diver's torso.

The invention includes two mating parts, the first affixed to either side of a BCD's web waistband via two off-the-shelf tri-glides, and a second part secured to a cylinder via either an off-the-shelf web cylinder band/clamp or stainless steel hose-clamp. Traditional arrangements are employed to position the cylinder valve comfortably near the diver's armpit. Having two sets of appropriately positioned mating parts enables mounting and dismounting cylinders along both sides of a diver's torso.

The first part includes a stainless steel rod bent and welded into a rectangle with the two short sides bent 90 degrees in the Z axis to form a rectangular shelf-like opening. Orienting the shelf to the bottom and weaving a BCD web waistband through a tri-glide and one short side, then through a second tri-glide and the other short side secures the rectangle to the waistband with the shelf protruding from below the waistband. An alternate first part includes standard tri-glides welded to the back of the bent rod to better distribute the cylinder's weight on the waistband. An extended first part with integral custom tri-glides shares the same area of a BCD web waistband with a removable weight system. To do so, a stainless steel rod is bent to form a taller rectangle and deeper shelf having the same length as that of the standard first part. The taller, vertical portion of the rectangle enables the shelf to extend below the weight system. The deeper shelf provides access for the second part that is secured to the dive cylinder, even when the weight system is fully loaded with weights. Custom tri-glides that extend below and partway under the shelf are welded to the back of the bent rod to distribute the cylinder's weight on the waistband and to strengthen the shelf which is subjected to greater bending forces due to its increased depth.

The original second part of some embodiments of the invention includes a stainless steel rod bent into a flat sided oval (or oblong shape) with the long axis oriented horizontally and the short axis vertically. Further, the upper side of the oval is opened by bending the rod 90 degrees away from the oval's long axis and then 180 degrees in the Z axis. Finally, the legs thus formed are further bent 90 degrees toward one another. The result is an open topped, flat sided oval with each leg forming a hook. The legs are then embedded in a rubber pad having a concave surface that matches the side of a dive cylinder and through which a horizontal slot provides for passage of either a web cylinder band or stainless steel hose clamp. An improved second part eliminates the 180-degree bend in the Z axis. The unit is then turned upside down to orient the flat sided oval below the rubber pad. Additional bends to the rod within the rubber pad enable the flat sided oval to be closer to the cylinder side of the pad. When compared to the original, the improved second part reduces the distance between the diver's torso and cylinder by half.

A key feature of at least some embodiments of the invention concerns the long axis of the second part's oval which is greater than the length of the shelf of any first part, but having a diagonal dimension, from the outside end of the oval to the inside curve forming the oval's open top side, slightly less than the length of the shelf of the first part. By tilting ("mis-aligning") the cylinder, one end of the oval may be inserted into the open shelf of the first part. As the cylinder is aligned with the diver's torso the opposite end of the oval enters the shelf and locks the two parts together when fully aligned. In other words, the BCD bracket and cylinder bracket are mated when the dive cylinder is mis-aligned with the diver's torso and subsequently interlocked when the dive cylinder is pivoted into alignment with the diver's torso. In some embodiments, the long axis of the oval can only enter or exit the shelf-like opening when the cylinder bracket is pivoted more than 30 degrees from the locked position. Traditional arrangements for holding the cylinder valve close to the diver's armpit keeps the invention from disengaging.

Figure 2:
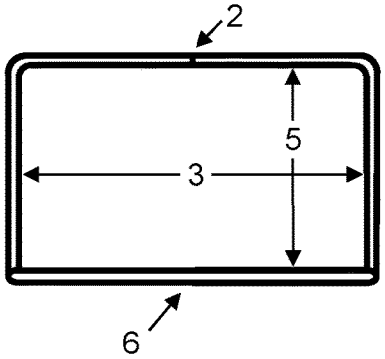
FIG. 2 is a front plan view of a BCD Bracket.
Figure 3:
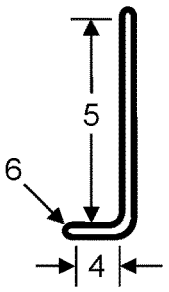
FIG. 3 is a side plan view of a BCD Bracket.
Figure 4:
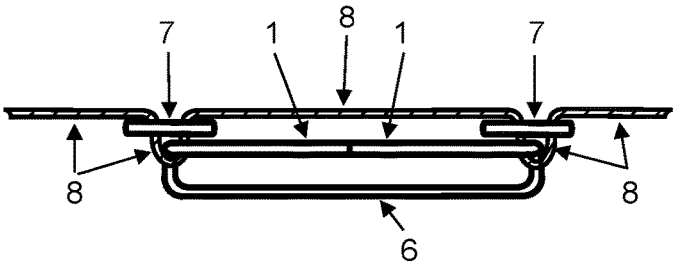
FIG. 4 is a top plan view of a BCD Bracket affixed to a BCD web waistband via two off-the-shelf tri-glides, with hidden lines omitted for clarity.
Figure 5:
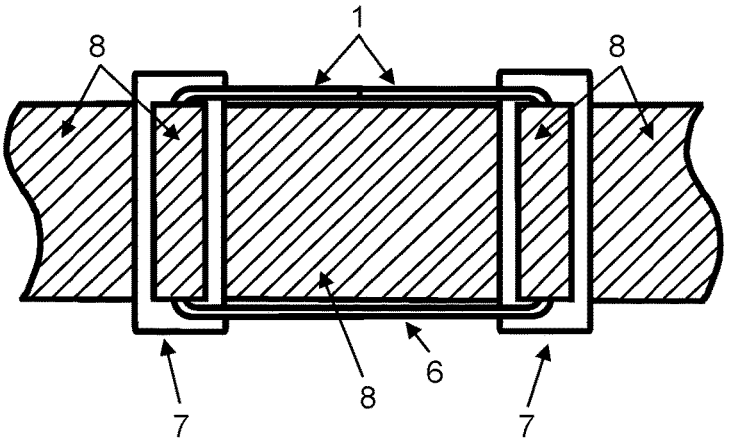
FIG. 5 is a front plan view of a BCD Bracket affixed to a BCD web waistband via two off-the-shelf tri-glides, with hidden lines omitted for clarity.
Figure 6:
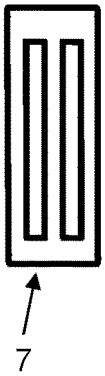
FIG. 6 is a front plan view of an off-the-shelf tri-glide which may or may not be welded to the back of each vertical component of a BCD Bracket and utilized to affix a BCD Bracket to a BCD web waistband as depicted in FIGS. 4 and 5.
Figure 7:
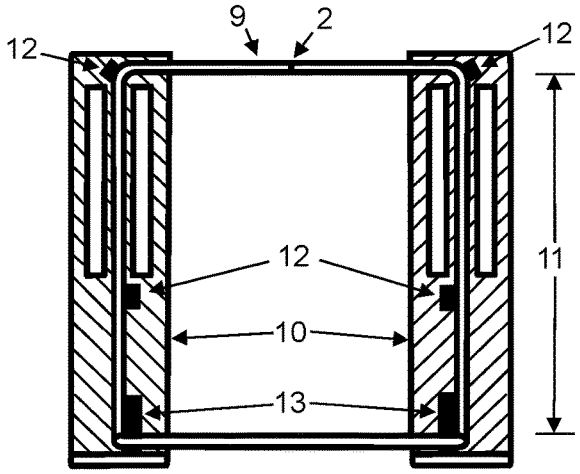
FIG. 7 is a front plan view of an Extended BCD Bracket with integral custom tri-glides, to be utilized in conjunction with a removable weight system sharing the same area of waistband.
Figure 8:
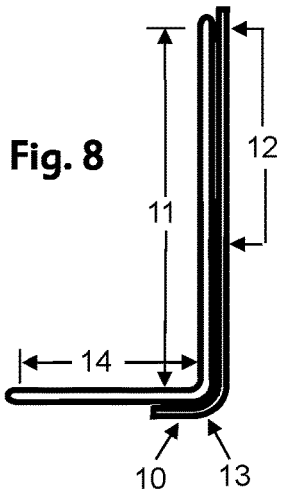
FIG. 8 is a side plan view of an Extended BCD Bracket with integral custom tri-glides.

In one particularly advantageous embodiment of the invention, FIG. 1 illustrates a BCD Bracket having two ends 1 of the bent rod connected by a weld at 2. Dimension 3 on FIG. 1 must be marginally greater than the distance between 24 and 25 or 26 and 27 of FIG. 18. Dimension 4 of FIG. 1 must be great enough to accommodate the diameter of rod used in the Cylinder Bracket. Dimension 5 on FIG. 2 must accommodate a standard 2" web waistband in at least some embodiments. 6 on FIG. 2 illustrates the long edge of an open shelf. In the advantageous embodiment, the BCD Bracket is affixed to a 2" BCD web waistband 8 by means of two tri-glides 7 as depicted in FIGS. 4 and 5. FIG. 6 illustrates an off-the-shelf tri-glide 7 that may or may not be welded to the back of the BCD Bracket depicted in FIGS. 1, 2 and 3. Dimensions provided in this specification are provided for the sake of illustration and may be selectively varied as would be understood by those of skill in the art.

The BCD Bracket illustrated by way of example in FIGS. 1 through 5 inclusive should utilize stainless steel rod of sufficient quality, e.g. grade 316, to resist rusting in a salt water environment and of sufficient strength to resist deformation when subjected to normal loads such as the weight imposed by steel cylinders or accidental loads such as those occurring if a cylinder is dropped onto the BCD. All bends have a 0.25" radius in the illustrated embodiment.

FIGS. 7 through 10 inclusive illustrate by way of example the Extended BCD Bracket to be utilized in conjunction with a removable weight system. 10 identifies the custom tri-glides that are welded to bracket 9 at locations 12 and 13. Dimension 11 is sufficient to place the shelf below a removable weight system and dimension 14 provides sufficient extension to the shelf so that it may be accessible from below a removable weight system, even when the weight system is loaded to its maximum. All bends to the stainless rod have a 0.25" radius in this embodiment.

Figure 9:
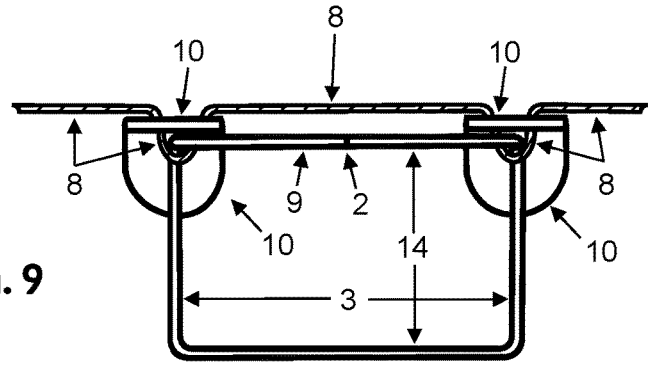
FIG. 9 is a top plan view of an Extended BCD Bracket with integral custom tri-glides, having a web waistband running through it, and with hidden lines omitted for clarity.

Being a top plan view, FIG. 9 clearly depicts the extended shelf having dimension 14. Also of note is that the width of the shelf, identified as dimension 3 matches that of the standard BCD Bracket in order that either an original or improved Cylinder Bracket may fit either a BCD Bracket or Extended BCD Bracket.

Figure 10:
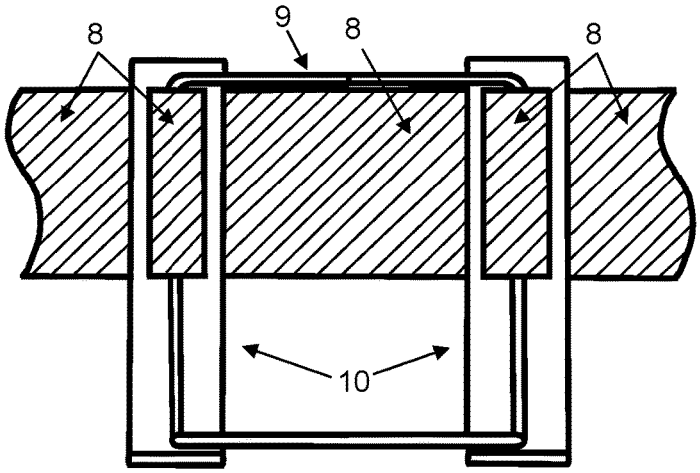
FIG. 10 is a front plan view of an Extended BCD Bracket with integral custom tri-glides, having a web waistband running through it, and with hidden lines omitted for clarity, where a removable weight system sharing the same area of waistband would hide all but the lowest portion of the Extended BCD Bracket.

FIG. 10 illustrates how an Extended BCD Bracket would be mounted on a web waistband. When mounted in conjunction with a removable weight system, the Extended BCD Bracket could be located between the mounting loops of the weight system, or staggered with one tri-glide between the weight system loops and the other to one side or the other depending on the desired position of the bracket relative to the diver's waist, i.e., further to the side or toward the front.

Figure 11:
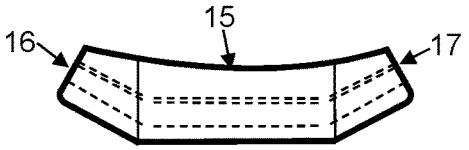
FIG. 11 is a top plan view of the rubber portion of the original Cylinder Bracket.
Figure 13:
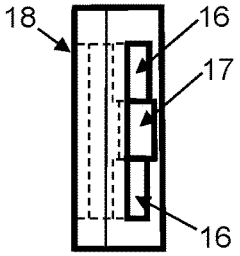
FIG. 13 is a side plan view of the rubber portion of the original Cylinder Bracket.

Being a top plan view of the rubber portion of the original Cylinder Bracket, 15 on FIG. 11 identifies the surface that conforms to the side of a typical 80 cubic foot 7.25" diameter dive cylinder. Utilizing rubber having a Shore Hardness rating of approximately 85 provides sufficient hardness to maintain shape during normal use, but soft enough to conform to slightly larger or smaller diameter dive cylinders such as 5" or 8.25" diameter dive cylinders. Furthermore, the surface of 15 includes horizontal ridges of approximately 0.125" wide×0.0625" deep spaced approximately 0.5" on centre in at least some embodiments. These ridges are meant to improve the vertical grip of the original Cylinder Bracket when secured to the side of a dive cylinder. Lastly, the rubber must be UV resistant to avoid breakdown arising from sun exposure. The slot through which a 2" web cylinder band passes is identified as 16 on FIGS. 11 and 13, with 17 being the added indentation to assist positioning a stainless steel hose-clamp as an alternative to utilizing a web cylinder band. Alternate arrangements may be provided in which the slot is specifically designed to accommodate only one of either a 2" web cylinder band or a stainless steel hose clamp in order to facilitate a thinner overall profile for the rubber pad.

Opening 18 to slot 16/17 identified on FIGS. 12, 13, 15 and 16 is provided to ease passing a web cylinder band or hose-clamp through the slot from one side to the other. Opening 18 may be omitted in order to present a smooth, uninterrupted surface which ultimately rests against the BCD web waistband.

Figure 12:
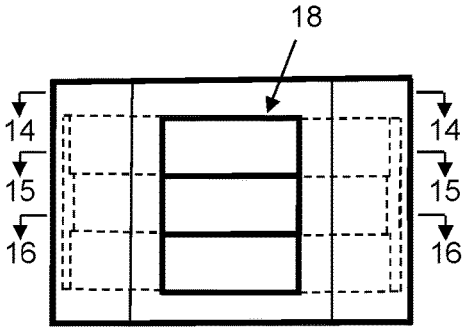
FIG. 12 is a front plan view of the rubber portion of the original Cylinder Bracket.
Figure 14:
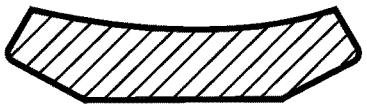
FIG. 14 is a sectional view taken generally on line 14-14 of FIG. 12.
Figure 15:
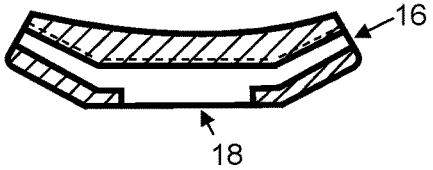
FIG. 15 is a sectional view taken generally on line 15-15 of FIG. 12.
Figure 16:
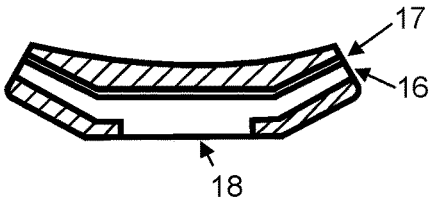
FIG. 16 is a sectional view taken generally on line 16-16 of FIG. 12.

Section 14-14 of FIG. 12 is shown in cross-section on FIG. 14. It shows that solid rubber exists above and below slot 16/17 and opening 18. Section 15-15 of FIG. 15 depicts slot 16 which accommodates a 2" web cylinder band. Section 16-16 of FIG. 16 identifies indentation 17 to slot 16 which is meant to assist the correct positioning of a stainless steel hose clamp when used in place of a web cylinder band. Indentation 17 is situated at the middle of slot 16 to ensure that the clamping pressure of a stainless steel hose clamp is evenly distributed from top to bottom of the rubber pad.

Figure 17:
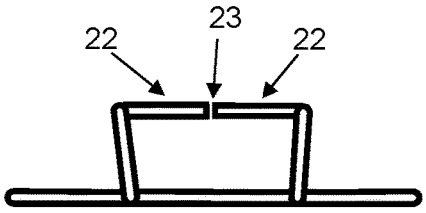
FIG. 17 is a top plan view of the stainless steel portion of the original Cylinder Bracket.
Figure 19:
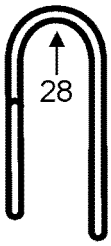
FIG. 19 is a side plan view of the stainless steel portion of the original Cylinder Bracket.
Figure 18:
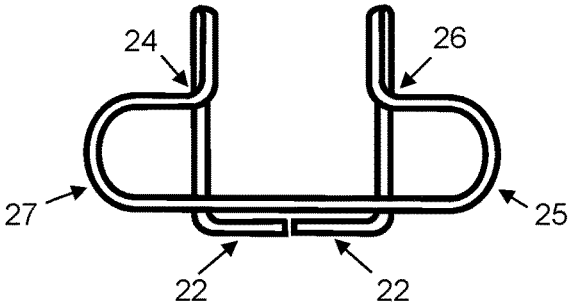
FIG. 18 is a front plan view of the stainless steel portion of the original Cylinder Bracket with hidden lines omitted for clarity.

FIGS. 17, 18 and 19 provide three views of the bent metal rod, legs 22 of which are embedded in the rubber portion of the original Cylinder Bracket. The bottom of legs 22 are bent inward to ensure that the embedded legs cannot easily break out of the rubber. Gap 23 between the ends of the legs provides opportunity to slide rubber O-rings onto the legs in order to better hold the metal bracket in its correct position during the molding process of the rubber pad.

The distance between the inside of curve 24 and the outside of curve 25 on FIG. 18 must equal the distance between the inside of curve 26 and the outside of curve 27 in order for the original Cylinder Bracket to be useable for either a left or right side mounted cylinder. Furthermore these dimensions must be slightly less than dimension 3 of FIGS. 1, 2 and 9, otherwise the original Cylinder Bracket will not be able to enter the shelf associated with either a BCD Bracket or Extended BCD Bracket. If the distance between 24 and 25 or 26 and 27 is significantly less than dimension 3 there is a danger that the two brackets may accidently detach during normal operation. All bends except those at 25, 27 and 28 are 0.25" radius in the illustrated embodiment. Bends at 25 and 27 are 0.5" radius in the illustrated embodiment.

In the illustrated embodiment, hook 28 in FIG. 19 is formed from a 180 degree, 0.375" radius bend to each leg in the Z axis. Once inserted in the shelf of the BCD Bracket, it is this hook that holds the weight of the cylinder.

The long vertical portion of the legs are positioned within the rubber pad so that the legs are between the cylinder and the web cylinder band or hose-clamp. In this manner, failure of the rubber pad does not cause catastrophic failure of the overall mounting system.

The rod portion of the original Cylinder Bracket illustrated in the embodiment of FIGS. 17, 18 and 19 should utilize stainless steel rod of sufficient quality, e.g. grade 316, to resist rusting in a salt water environment and of sufficient strength to resist deformation when subjected to normal loads such as the weight imposed by steel cylinders or accidental loads such as those occurring if a cylinder is dropped on its side or when multiple cylinders are stacked horizontally on top of one another during transport.

Figure 20:
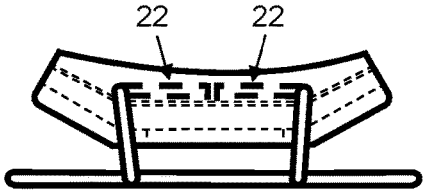
FIG. 20 is a top plan view of the original Cylinder Bracket having the stainless steel portion embedded in the rubber portion.
Figure 22:
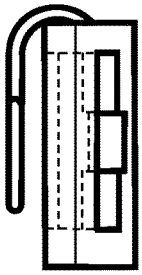
FIG. 22 is a side plan view of the original Cylinder Bracket, with hidden lines associated with the stainless steel portion of the bracket omitted for clarity.
Figure 21:
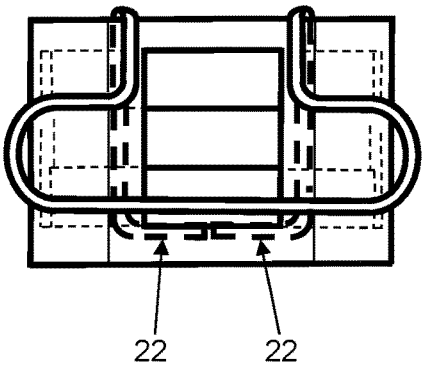
FIG. 21 is a front plan view of the original Cylinder Bracket having the stainless steel portion embedded in the rubber portion.

The combined parts of the original Cylinder Bracket, namely the rubber pad depicted in FIGS. 11 through 16 inclusive and the bent metal rod depicted in FIGS. 17, 18 and 19 are illustrated in FIGS. 20 through 22 inclusive. In particular, the legs including the bent portion 22 thereof which are embedded within the rubber are identified in FIGS. 20 and 21 as hidden lines. Also note in FIG. 22 the absence of any gap between the inside curve of 28 and the rubber top which might otherwise cause a BCD Bracket to become trapped, thereby hampering dismounting of the original Cylinder Bracket from the BCD Bracket.

Figure 23:
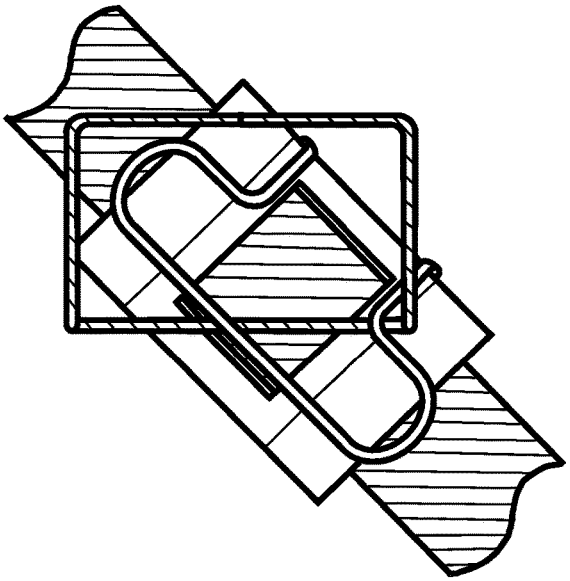
FIG. 23 is a back plan view of a BCD Bracket and a front plan view of the original Cylinder Bracket, having a web cylinder band running through it, with the original Cylinder Bracket oriented so as to present the lowered end of the flat-sided oval into the BCD Bracket, as would be the case prior to locking the original Cylinder Bracket into the BCD Bracket, shown with the BCD waistband, tri-glides and all hidden lines omitted for clarity, and shown where, in this plan view, the dive cylinder would be behind and the diver's waist in front of the diagram.
Figure 25:
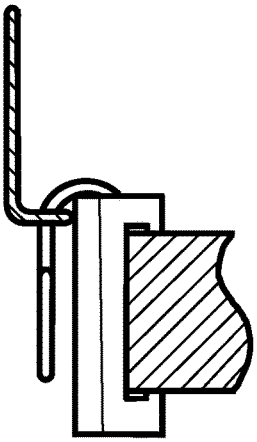
FIG. 25 is a side plan view of both a BCD Bracket and the original Cylinder Bracket, the latter having a web cylinder band running through it, oriented in the final locked position, shown with the BCD waistband, tri-glides and all hidden lines omitted for clarity, and shown where, in this plan view, the diver's waist would be to the left and the dive cylinder to the right.
Figure 24:
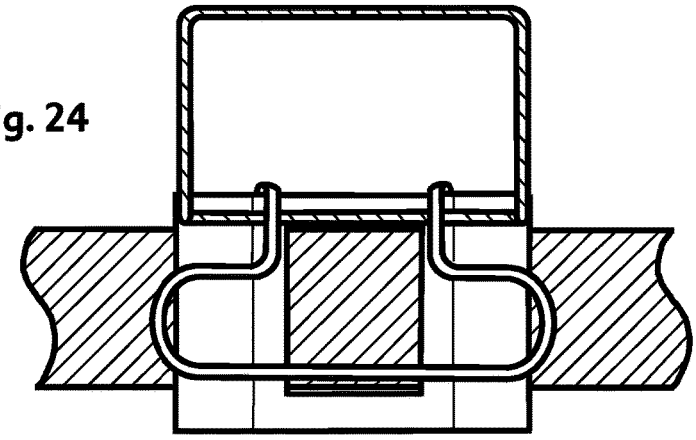
FIG. 24 is a back plan view of a BCD Bracket and a front plan view of the original Cylinder Bracket, having a web cylinder band running through it, oriented in the final locked position, shown with the BCD waistband, tri-glides and all hidden lines omitted for clarity, and shown where, in this plan view, the dive cylinder would be behind and the diver's waist in front of the diagram.

FIG. 23 depicts the position of the original Cylinder Bracket relative to a BCD Bracket when first engaging the two or near completion of dismounting. In particular and assuming the diver is standing prior to entering the water, when the dive cylinder is tilted approximately 45 degrees, one end of the flat-sided oval may be slipped into the open top of the BCD Bracket shelf. Once in the position of FIG. 23, the cylinder may then be tilted to vertical, during which movement, the opposite end of the flat-sided oval will slip through the open shelf. FIGS. 24 and 25 depict the original Cylinder Bracket in its final, locked position relative to the BCD Bracket. (Note: FIGS. 23, 24 and 25 omit the BCD waistband and tri-glides as they would block the view of the original Cylinder Bracket relative to the BCD Bracket.)

FIGS. 26 through 31 inclusive depict the rubber portion of an improved Cylinder Bracket. The only differences between the rubber portion of the original, FIGS. 11 through 16 inclusive, versus the improved Cylinder Bracket is the extension of the top on the improved model. This tapered extension is meant to provide less chance for snagging or catching objects during the normal course of activity and to provide a taller pad with room for longer rod legs within in order to reduce the chance of pulling the pad away from a cylinder's side.

Legs 22 of FIG. 32 are bent to conform with the curvature of 15 in the embodiment shown in FIG. 26. Additional reversing bends 29 on FIG. 34 enable the stainless rod to be positioned between the web cylinder band and the cylinder whilst simultaneously positioning the flat-sided oval closer to the diver's hip. FIGS. 35, 36 and 37 depict the top, front and side views of the improved Cylinder Bracket respectively.

Figure 38:
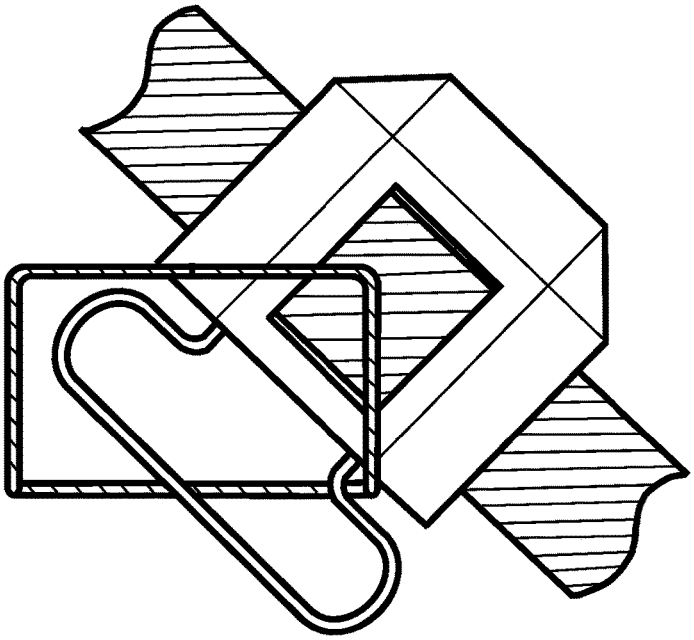
FIG. 38 is a back plan view of a BCD Bracket and a front plan view of the improved Cylinder Bracket, having a web cylinder band running through it, with the improved Cylinder Bracket oriented so as to present the lowered end of the flat-sided oval into the BCD Bracket, as would be the case prior to locking the improved Cylinder Bracket into the BCD Bracket, shown with the BCD waistband, tri-glides and all hidden lines omitted for clarity, and shown where, in this plan view, the dive cylinder would be behind and the diver's waist in front of the diagram.
Figure 39:
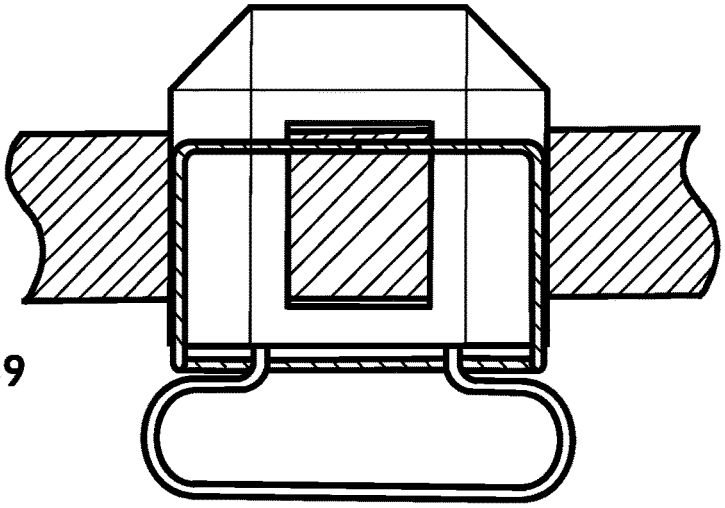
FIG. 39 is a back plan view of a BCD Bracket and a front plan view of the improved Cylinder Bracket, having a web cylinder band running through it, oriented in the final locked position, shown with the BCD waistband, tri-glides and all hidden lines omitted for clarity, and shown where, in this plan view, the dive cylinder would be behind and the diver's waist in front of the diagram.
Figure 40:
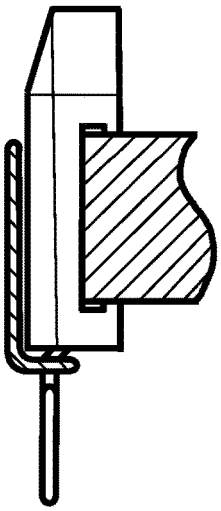
FIG. 40 is a side plan view of both a BCD Bracket and the improved Cylinder Bracket, the latter having a web cylinder band running through it, oriented in the final locked position, shown with the BCD waistband, tri-glides and all hidden lines omitted for clarity, and shown where, in this plan view, the diver's waist would be to the left and the dive cylinder to the right.

FIGS. 38, 39 and 40 depict the mounting, locked and side views of the improved Cylinder Bracket in like manner to FIGS. 23, 24 and 25 of the original. Comparison of FIGS. 25 and 40 clearly demonstrate the reduced distance between the diver's torso, i.e., the left side of each diagram, and the dive cylinder, i.e., the right side of each diagram, arising from the improved version. Having the side of the improved Cylinder Bracket snug against the BCD Bracket has the added benefit of reducing movement between the cylinder and the diver.

Mounting and dismounting a Cylinder Bracket onto an Extended BCD Bracket would follow the same procedure as that for a standard BCD Bracket.

Regardless of which versions of BCD and Cylinder Brackets employed, rather than simply tilting the cylinder in preparation for mating the two brackets, the diver may find it advantageous to hold the cylinder horizontally whilst standing, with one hand holding the cylinder bottom and the other holding the valve. For mounting on the diver's left side, the left hand should hold the cylinder bottom. In this manner, one end of the flat-sided oval is pointing straight down, making it simpler to present that end into the BCD Bracket's open shelf. Having completed this first step, the brackets may take the cylinder's weight, thereby relieving the left hand for the task of securing the cylinder valve to the BCD. With the weight being borne by the brackets, the diver may easily tilt the cylinder into its vertical locked position with the right hand. If the Cylinder Bracket is positioned above the cylinder's centre of gravity, the cylinder will stay in the vertical position by gravity alone while securing the cylinder valve to the BCD. Switching hand locations makes mounting a cylinder on the diver's right equally simple. In-water practice, mounting and dismounting cylinders from either side while swimming becomes second nature in short order.

Dismounting may be accomplished by reversing the process, namely, disengaging the cylinder valve constraint, tilting the cylinder forward approximately 45 degrees so that the back end of the flat-sided oval exits the BCD Bracket's shelf, and lifting the cylinder so as to complete disengagement of the Cylinder Bracket and BCD Bracket. While swimming with aluminum cylinders that are positively buoyant, it may be necessary to push downward on the cylinder's side while tilting the cylinder forward in order for the back end of the flat-sided oval to disengage the BCD Bracket. This is a design feature to ensure that buoyant cylinders do not accidentally disengage from the BCD.

Partial disengagement of the cylinder from the diver's side prior to entering a confined underwater space may be effected by tilting the cylinder with the cylinder valve forward, against the resistance imposed by the shock cord around the cylinder valve, then lifting the cylinder in its tilted position so as to disengage the Cylinder Bracket and BCD Bracket while keeping the shock cord wrapped around the cylinder valve. The reverse procedure secures the cylinder alongside the diver's torso. Grasping the cylinder valve with the hand opposite the side on which the cylinder resides as identified above simplifies these procedures.

It will be apparent that various changes and modifications can be made without departing from the scope of the invention as defined in the claims. Utilizing any arrangement of two locking brackets regardless of the locking design and even though such brackets may be secured to the BCD and/or dive cylinder utilizing different methods than those presented does not affect the underlying principles. Similarly, changing the type of materials utilized to fabricate the brackets or the dimensions thereof does not affect the underlying principles. Nor does use of cylinders for different applications such as those used for decompression cylinders and stage bottles mounted alongside the diver's torso and used in conjunction with back mounted cylinders affect the underlying principles.

The invention claimed is:

1. A scuba cylinder lower side mounting system comprising:

a buoyancy control device (BCD) bracket mounted to a waistband, the BCD bracket having a rectangular shelf-like opening; and a cylinder bracket affixed to the dive cylinder, the bracket comprising a bent rod partly embedded in a rubber pad, wherein the rod is bent into a flat-sided oval with the long axis oriented horizontally and the short axis vertically such that the oval can be inserted into the shelf-like opening, whereby the BCD bracket interlocks with the cylinder bracket when the dive cylinder is aligned with the diver's torso.

2. The system of claim 1 wherein the BCD bracket may be positioned on either side of the waistband to facilitate location of dive cylinders on either side of the diver's torso.

3. The system of claim 1 wherein metal portions of both the BCD bracket and cylinder bracket are made of stainless steel so as to minimize oxidation in salt water.

4. The system of claim 1 wherein the BCD bracket is affixed to the waistband by two tri-glides.

5. The system of claim 4 wherein the tri-glides are welded to the BCD bracket.

6. The system of claim 1 wherein the BCD bracket is extended vertically and the shelf-like opening extended horizontally such that the shelf-like opening is accessible below and in front of a removable weight system sharing the same space on the waistband and affixed to the waistband by tri-glides welded to the BCD bracket.

7. The system of claim 1 wherein the rubber pad is UV resistant and has a Shore Hardness of approximately 85.

8. The system of claim 1 wherein the rubber pad has a concave back surface with horizontal ridges to aid in gripping the cylinder.

9. The system of claim 1 wherein the long axis of the oval can only enter or exit the shelf-like opening when the cylinder bracket is pivoted more than 30 degrees from the locked position.

10. The system of claim 1 wherein the rubber pad has a slot to accommodate a cylinder band, a stainless steel hose-clamp or both.

11. The system of claim 1 wherein legs of the rod embedded within the rubber pad are situated between the slot and the concave back surface so that failure of the rubber pad does not result in accidental detachment of the cylinder from the diver.

12. The system of claim 1 wherein legs of the flat-sided oval, that are embedded within the rubber pad, extend from the top of the rubber pad and are bent 180 degrees such that the flat-sided oval forms a hook with respect to the rubber pad.

13. The system of claim 12 wherein the ends of the legs of the flat-sided oval, that are embedded within the rubber pad, are bent toward each other to secure the legs within the rubber pad.

14. The system of claim 12 wherein the flat-sided oval excludes the 180 degree bend to the legs, with the rubber pad turned upside down so that the flat-sided oval is situated below the rubber pad.

* * * * *